US006705099B2

(12) United States Patent
Cho et al.

(10) Patent No.: US 6,705,099 B2
(45) Date of Patent: Mar. 16, 2004

(54) CONCENTRATION COOLING APPARATUS FOR REFRIGERATOR

(75) Inventors: Seong-Ho Cho, Seoul (KR); In-Seop Lee, Gyeonggi-Do (KR); In-Won Lee, Gyeonggi-Do (KR); Jae-Yong Sung, Seoul (KR); Jay-Ho Choi, Seoul (KR); Kwang-Hyup An, Seoul (KR); Jeong-Ho Lee, Gyeonggi-Do (KR); Young-Sok Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/315,994

(22) Filed: Dec. 11, 2002

(65) Prior Publication Data

US 2004/0016248 A1 Jan. 29, 2004

(30) Foreign Application Priority Data

Jul. 26, 2002 (KR) ..... 2002-44336

(51) Int. Cl.[7] ..... F25D 17/04
(52) U.S. Cl. ..... 62/186; 236/49.3
(58) Field of Search ..... 62/186, 404, 407, 62/408, 81; 236/49.3; 454/108, 154, 305

(56) References Cited

U.S. PATENT DOCUMENTS 4,912,943 A * 4/1990 Hubert et al. ..... 62/374
5,737,935 A * 4/1998 Heo ..... 62/186
5,775,124 A * 7/1998 Park et al. ..... 62/408
5,778,688 A * 7/1998 Park et al. ..... 62/89
5,907,953 A * 6/1999 Kang et al. ..... 62/89
6,055,820 A * 5/2000 Jeong et al. ..... 62/186
6,622,504 B2 * 9/2003 Lee et al. ..... 62/186
2003/0131541 A1 * 7/2003 Lee et al. ..... 52/79.1

* cited by examiner

*Primary Examiner*—Marc Norman
(74) *Attorney, Agent, or Firm*—Greenblum & Bernstein, P.L.C.

(57) ABSTRACT

A concentration cooling apparatus for a refrigerator, including a housing which is respectively mounted in one or more cold air guiding paths formed on a side wall of the chilling chamber to guide cold air to the side wall of the chilling chamber, a nozzle which is rotatably supported in the housing, for concentratedly injecting cold air to a region where a high temperature load is occurred in the chilling chamber, a temperature sensor which is mounted at the front of the nozzle, for sensing the region where the high temperature load is occurred, rotating together with the nozzle, and a nozzle driving portion for rotating the nozzle up and down as well as in the circumferential direction of the nozzle, can swiftly maintain a temperature inside of a chilling chamber as a uniform temperature by concentratedly discharging cold air into a region where a high temperature load is occurred inside the chilling chamber.

14 Claims, 9 Drawing Sheets

CONCENTRATION COOLING APPARATUS FOR REFRIGERATOR

BACKGROUND OF THE INVENTION

1. Field of the Invention

The present invention relates to a refrigerator and particularly, to a concentration cooling apparatus for a refrigerator, capable of swiftly maintaining a temperature inside of a chilling chamber as a uniform temperature by performing a swift cooling operation of a high temperature load by concentratedly injecting cold air into a region where a high temperature load is occurred inside the chilling chamber.

2. Description of the Background Art

Generally, a refrigerator includes a freezing chamber for keeping frozen food, and a chilling chamber for keeping chilled food, and a refrigerating cycle for supplying cold air to the freezing chamber and chilling chamber is positioned therein.

FIG. 1 is a perspective view showing a partially cut section of a conventional refrigerator, and FIG. 2 is a longitudinal sectional view showing a conventional chilling chamber.

The conventional refrigerator includes a main body 104 in which a pair of doors 102 opened and closed in both directions are mounted at the front side, having a receiving space therein, a freezing chamber 106 which is positioned at the left side of the main body 104, for keeping frozen food, a chilling chamber 108 which has a plurality of shelves 114 for keeping refrigeration food therein, which is divided by the freezing chamber 106 and partition 110 and is positioned at the right side of the main body 104, and a cold air supplying apparatus which is installed at the upper side of the freezing chamber 106, for supplying air which is cooled passing the refrigerating cycle to the freezing chamber 106 and chilling chamber 108.

The cold air supplying apparatus includes a ventilation fan 120 which is mounted on the upper rear wall of the freezing chamber 106, for coercively ventilating air which is cooled by passing the refrigerating cycle, a panel 128 which is positioned at the lower side of the ventilation fan 120, having a plurality of cold air discharging ports 130 are formed therein to supply cold air into the freezing chamber 106, a cold air supply path 132 which is formed at the upper side of the partition 110 for flowing cold air ventilated from the ventilation fan 120 to the chilling chamber 108, a cold air discharging duct 134 which is mounted at the upper portion of the chilling chamber 108 and is connected to the cold air supply path 132, for discharging cold air into the chilling chamber, and a cold air inflow path 138 which is formed at the lower side of the partition 110, and in which cold air which completed cooling operation circulating in the chilling chamber 108 is flowed into the refrigerating cycle.

Here, a plurality of cold air discharging ports 136 for discharging cold air to the chilling chamber 108 are formed at the front and lower sides of the cold air discharging duct 134.

A temperature sensor 140 is attached on one side of the chilling chamber 108, blocks supply of cold air to the chilling chamber 108 when the temperature of the chilling chamber 108 is lower than a predetermined level, and supplies cold air from the freezing chamber 106 when the temperature is higher than a predetermined level.

The operation of the conventional art with the above composition will be described as follows.

Firstly, when the refrigerating cycle is driven and the ventilation fan rotates, the cold air cooled by passing through the refrigerating cycle is discharged respectively to the cold air discharging port 130 of the panel 128 and cold air supply path 132 by a ventilation pressure of the ventilation fan 120.

The cold air discharged to the cold air discharging port 130 performs a freezing operation of a frozen food stored in the freezing chamber 106 circulating inside the freezing chamber 106.

The cold air supplied to the cold air supply path 132 is flowed to the cold air discharging duct 134 and is discharged into the chilling chamber through the cold air discharging port 136 which is formed in the cold air discharging duct 134.

Therefore, the cold air discharged into the chilling chamber 108 performs cooling operation of the chilled food stored in the chilling chamber 108 circulating in the chilling chamber 108, and the cold air which stops being cooled is flowed to the cold air inflow path 138 formed at the lower side of the partition 110 and is cooled again by the refrigerating cycle.

However, in the conventional refrigerator, since the cold air discharging duct is positioned at the upper side of the chilling chamber and cold air is supplied from the upper side to the lower side of the chilling chamber through the cold air discharging port formed in the cold air discharging duct, temperature deviation became deepened according to the distance from the cold air discharging port. Since the cold air is discharged only from the cold air discharging duct of the chilling chamber, it took much time to make temperature inside the chilling chamber uniform when a high temperature load is occurred due to a receiving food and the like in the chilling chamber. Therefore, a chilling time became longer, thus to degrading freshness of food stored in the chilling chamber.

Also, since the temperature sensor and cold air discharging port are positioned under the condition that they are respectively fixed in a predetermined region, the temperature detected by the temperature sensor was limited in a predetermined region in the chilling chamber and since cold air discharging was also limited in a predetermined region, in case a high temperature load is occurred in a region out of the portion where the temperature sensor can detect temperature, it took much time to get rid of temperature deviation inside the chilling chamber, and accordingly, the temperature inside the chilling chamber could not be swiftly uniformized.

Particularly, since the cold air discharging port is formed a the rear portion of the chilling chamber, cold air is concentrated in the rear portion and center portion of the chilling chamber near from the cold air discharging port. Therefore, food near the rear portion was over-cooled by much effect of the cold air and food which was kept near the door far from the cold air discharging port could not be relatively affected by the cold air and was under-cooled.

That is, since the internal temperature of the chilling chamber gains a more serious deviation according to the distance from the cold air discharging port, the distribution of the temperature inside the chilling chamber can not be uniformed.

SUMMARY OF THE INVENTION

Therefore, an object of the present invention is to provide a concentration cooling apparatus for a refrigerator, capable of swiftly maintaining a temperature inside of a chilling chamber as a uniform temperature by increasing a cooling speed of the high temperature load by concentratedly discharging cold air to a region where the high temperature load is occurred.

Also, the other object of the present invention is to provide a concentration cooling apparatus for refrigerator, capable of widening the sensing range of the temperature sensor by rotating a nozzle having a cold air injection port for discharging the cold air and the temperature for sensing temperature therein up and down as well as in the circumferential direction, and actively coping with the high temperature load occurred inside the chilling chamber by widening the cold air discharging range of the cold air injection port.

To achieve these and other advantages and in accordance with the purpose of the present invention, as embodied and broadly described herein, there is provided a concentration cooling apparatus for a refrigerator, comprising a housing which is respectively mounted in one or more cold air guiding paths formed on a side wall of the chilling chamber to guide cold air to the side wall of the chilling chamber a nozzle which is rotatably supported in the housing, for concentratedly injecting cold air to a region where a high temperature load is occurred in the chilling chamber a temperature sensor which is mounted at the front of the nozzle, for sensing the region where the high temperature load is occurred, rotating together with the nozzle, and a nozzle driving portion for rotating the nozzle up and down, and in the direction of the circumference.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

As the embodiment of the present invention, there can be plural ones and hereinafter, most preferred embodiments will be described.

Figure 1:
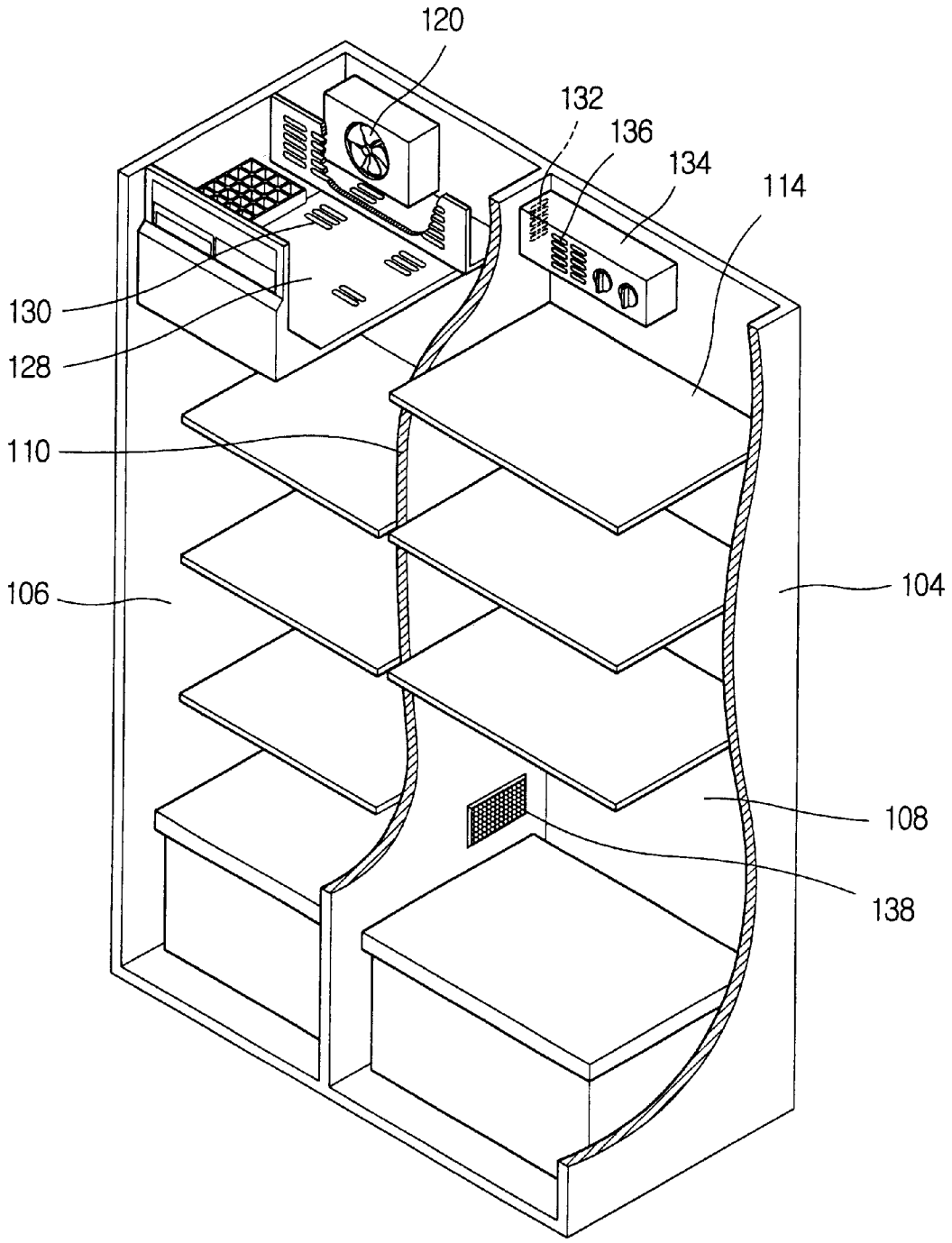
FIG. 1 CONVENTIONAL ART
FIG. 1 is a partially cut perspective view showing a conventional refrigerator.
Figure 2:
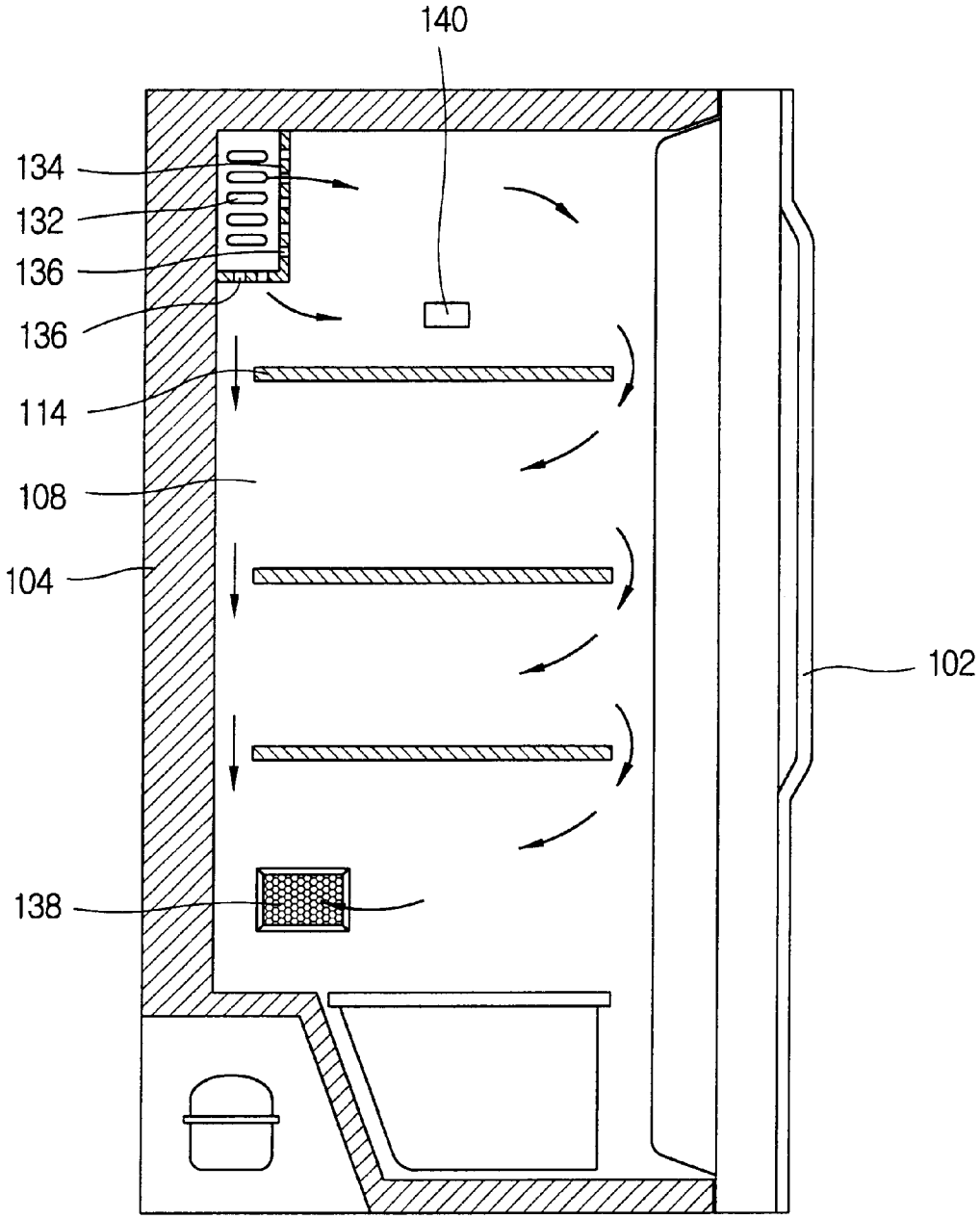
FIG. 2 CONVENTIONAL ART
FIG. 2 is a longitudinal sectional view showing a conventional chilling chamber of the conventional refrigerator.
Figure 3:
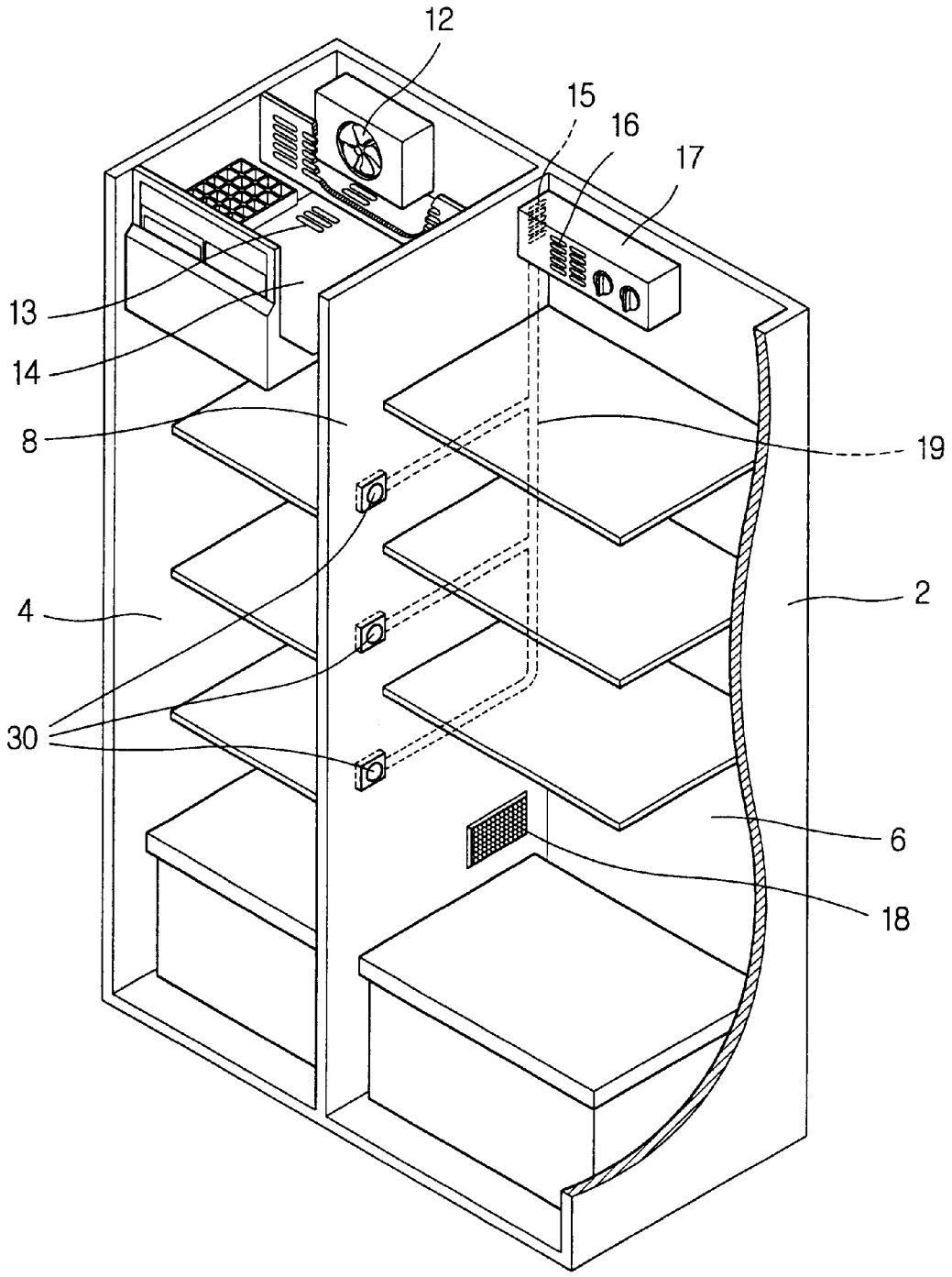
FIG. 3 is a partially cut perspective view showing a refrigerator in which a concentration cooling apparatus in accordance with the present invention is positioned.
Figure 4:
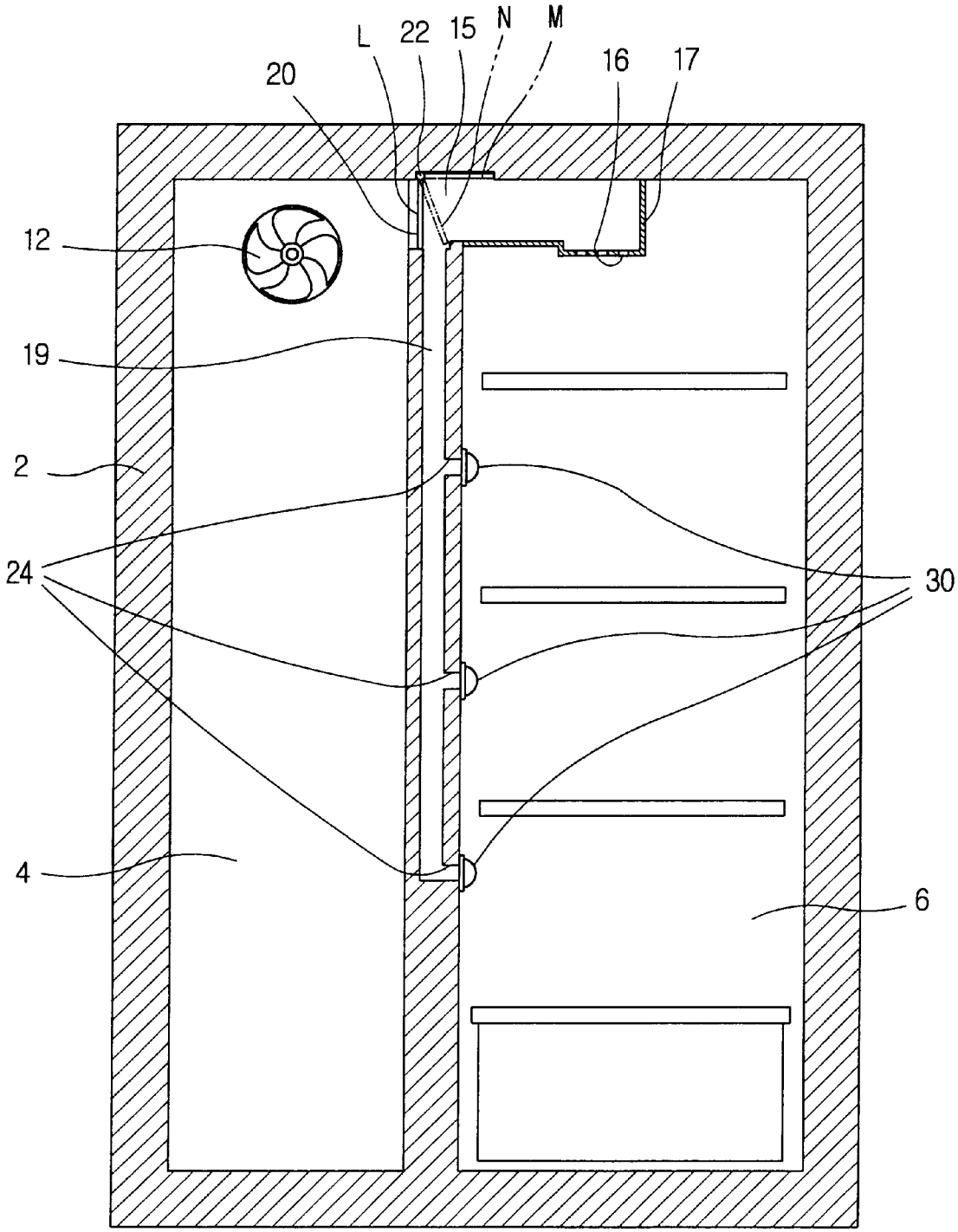
FIG. 4 is a longitudinal sectional view showing the concentration cooling apparatus in accordance with the present invention.

FIG. 3 is a partially cut perspective view showing a refrigerator in which a concentration cooling apparatus in accordance with the present invention is positioned and FIG. 4 is a longitudinal sectional view showing the concentration cooling apparatus in accordance with the present invention.

The refrigerator in which the concentration cooling apparatus in accordance with the present invention is formed includes a main body 2 in which a door (not shown) opened and closed in both directions is mounted, having a receiving space for storing food therein, a freezing chamber 4 which is positioned at a side between the left or right side of the main body 2, for storing frozen food, a chilling chamber 6 which is divided by the freezing chamber 6 and partition 8 and is positioned at the right side of the main body 4 and partition 8, for receiving chilled food, a refrigerating cycle (not shown) which is installed at a side of the main body 2, for generating cold air, and a concentration cooling apparatus for concentratedly discharging cold air to a region where a high temperature load is occurred inside of the chilling chamber 6.

The cold air supplying apparatus includes a ventilation fan 12 which is attached on the upper rear wall of the chilling chamber 4, for coercively ventilating the cold air which is cooled passing the refrigerating cycle, a panel 14 which is positioned at the lower side of the ventilation fan 12, for discharging cold air ventilated from the ventilation fan 12 to the freezing chamber 4, a cold air supply path 15 which is formed at the upper side of the partition 8 for flowing cold air ventilated from the ventilation fan 12 to the chilling chamber 6, and a cold air discharging duct 17 in which a cold air discharging port 16 which is connected to the cold air supply path 15 and is mounted at the upper portion of the chilling chamber 6, for discharging cold air into the chilling chamber 6, is formed.

At the lower side of the partition 8, a cold air inflow portion 18 for flowing the cold air completed to be cooled circulating in the chilling chamber 6 to the refrigerating cycle is formed.

The concentration cooling apparatus includes a cold air guiding path 19 which is extended in the cold air supply path 15 formed in the partition 8 and is formed one or more of it is formed in the side wall, for guiding cold air to the side wall of the chilling chamber 6, and a cold air injecting apparatus 30 which is connected with the cold air guiding path 19, positioned at the side wall of the chilling chamber 6 respectively, for injecting cold air to the region where the high temperature load was generated.

On the other hand, a damper 20 for opening and closing cold air flowed to the chilling chamber 6 or selectively disclosing the cold air supplying duct 17 and cold air guiding path 19 is formed.

The damper 20 is formed in a circular type that is rotably mounted by a hinge shaft 22 on the upper side surface of the cold air supply path 15. The hinge shaft 22 is connected to a driving device (not shown) and the damper 20 rotates when the hinge shaft 22 is operated.

That is, as shown in FIG. 4, when the damper 20 is positioned in the first position L by the operation of the driving device, cold air supply from the freezing chamber 6 becomes blocked, if the damper is positioned in the second position M, the cold air is supplied to the cold air guiding path 19 and cold air discharging duct 17. When the damper is positioned in the third position N, cold air is supplied to the cold air guiding path 19 and supply of cold air to the cold air discharging duct 17 becomes blocked.

The cold air injecting apparatus 30 will be described with reference to FIGS. 5 to 9.

Figure 5:
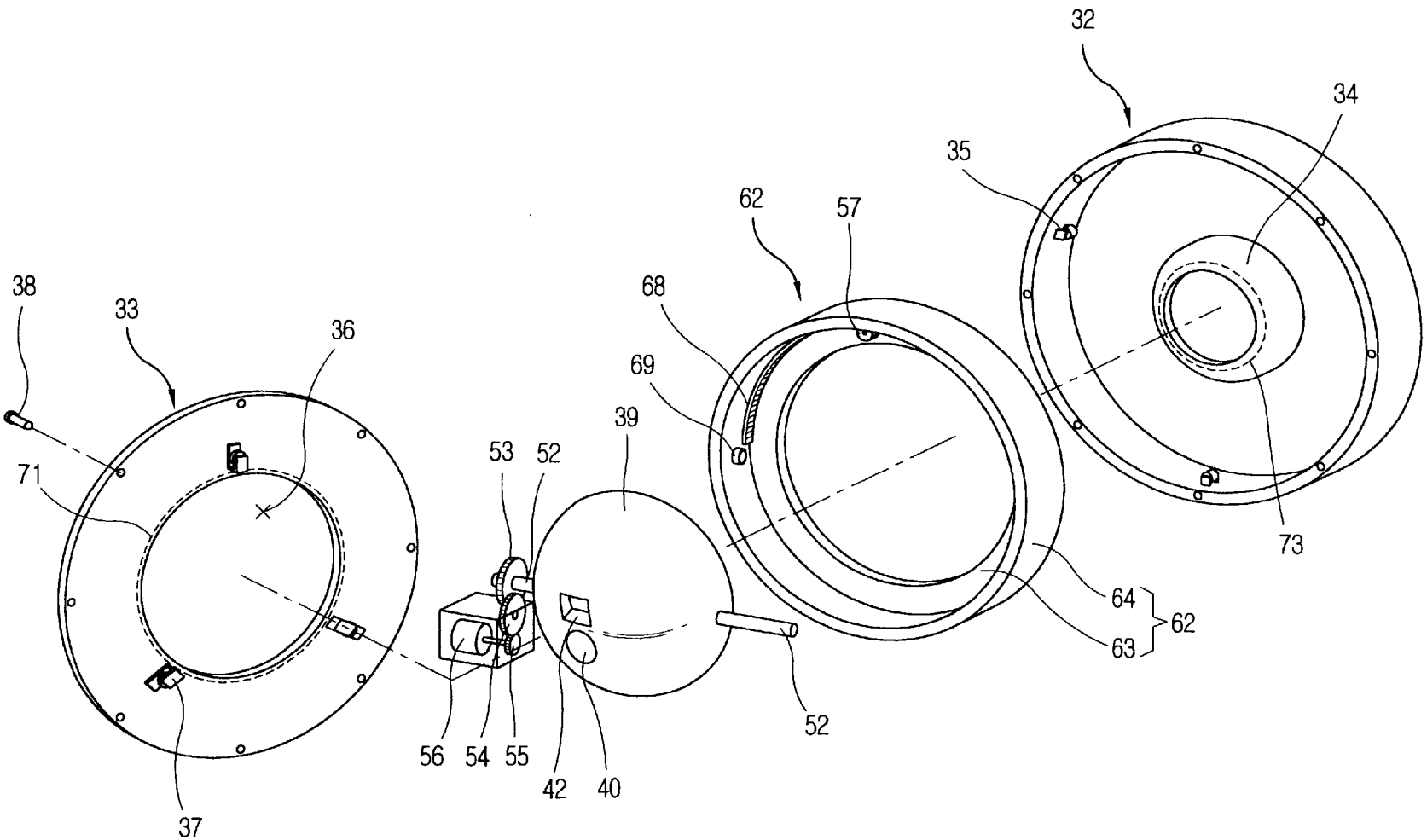
FIG. 5 is a partially perspective view showing a disjointed cold air injecting apparatus of the concentration cooling apparatus in accordance with the present invention.
Figure 6:
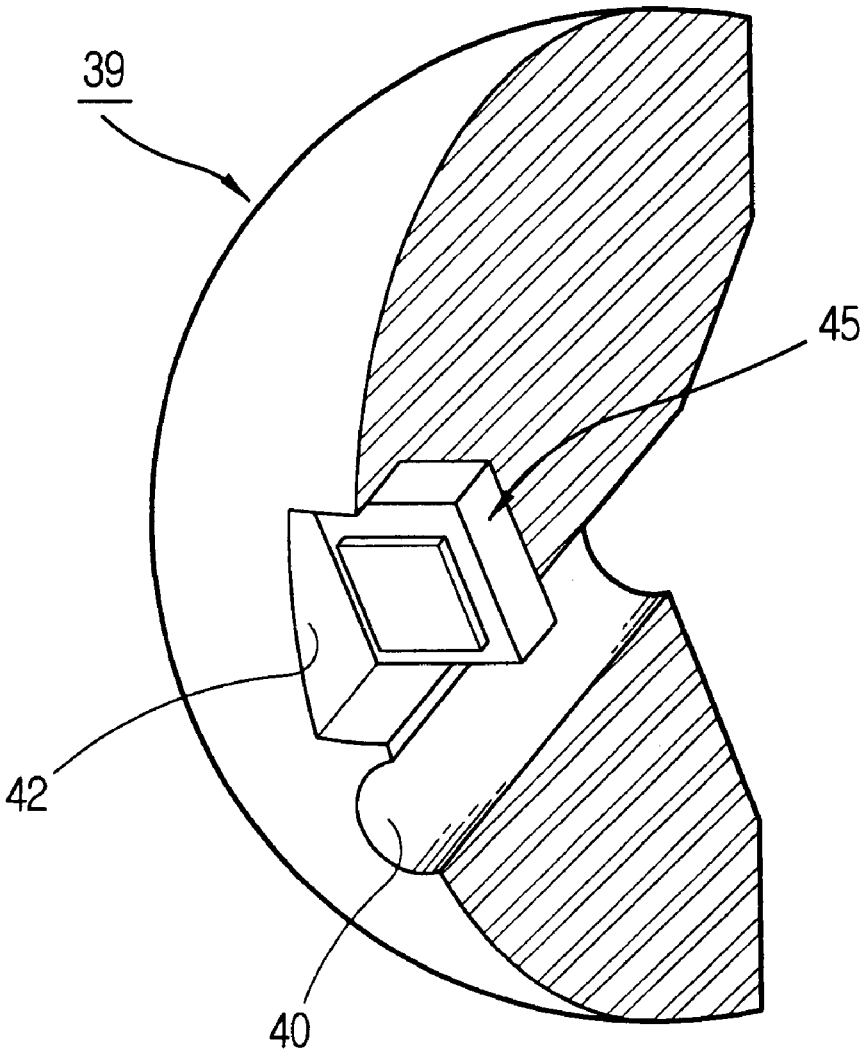
FIG. 6 is a partially cut perspective view showing a nozzle of the cold air injecting apparatus in accordance with the present invention.
Figure 7:
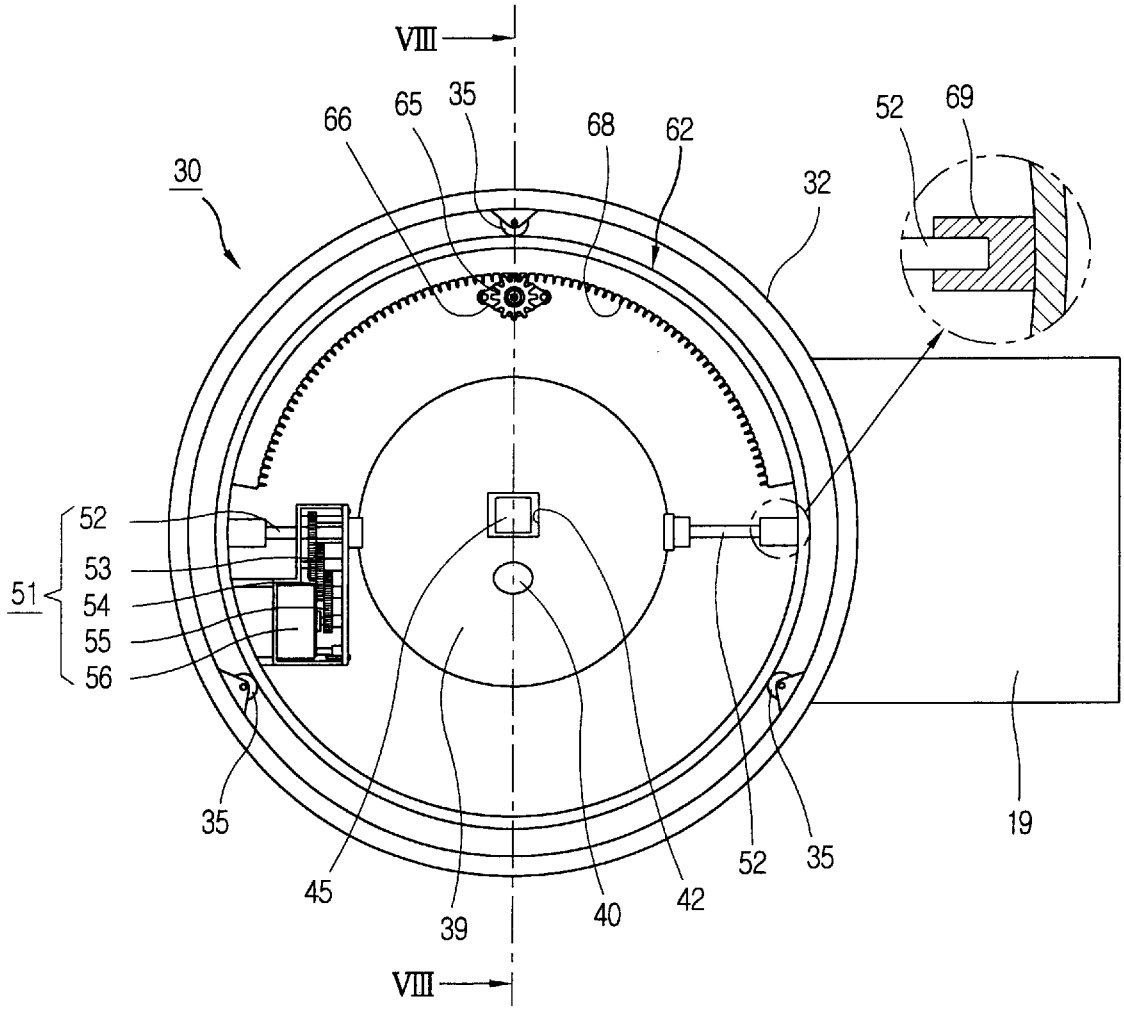
FIG. 7 is a front view showing the cold air injecting apparatus in accordance with the present invention.
Figure 8:
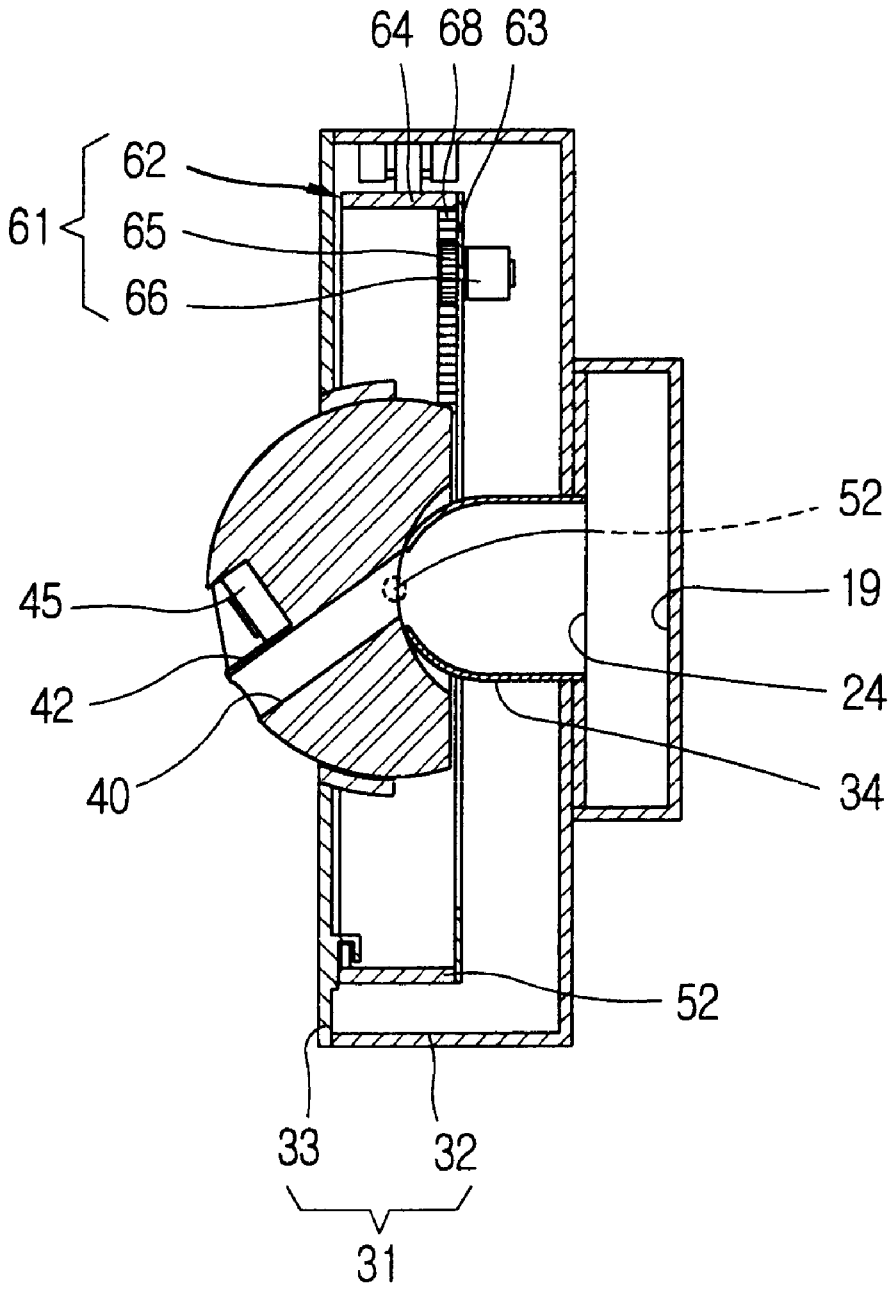
FIG. 8 is a cross-sectional view taken along section line VIII—VIII of FIG. 7.
Figure 9:
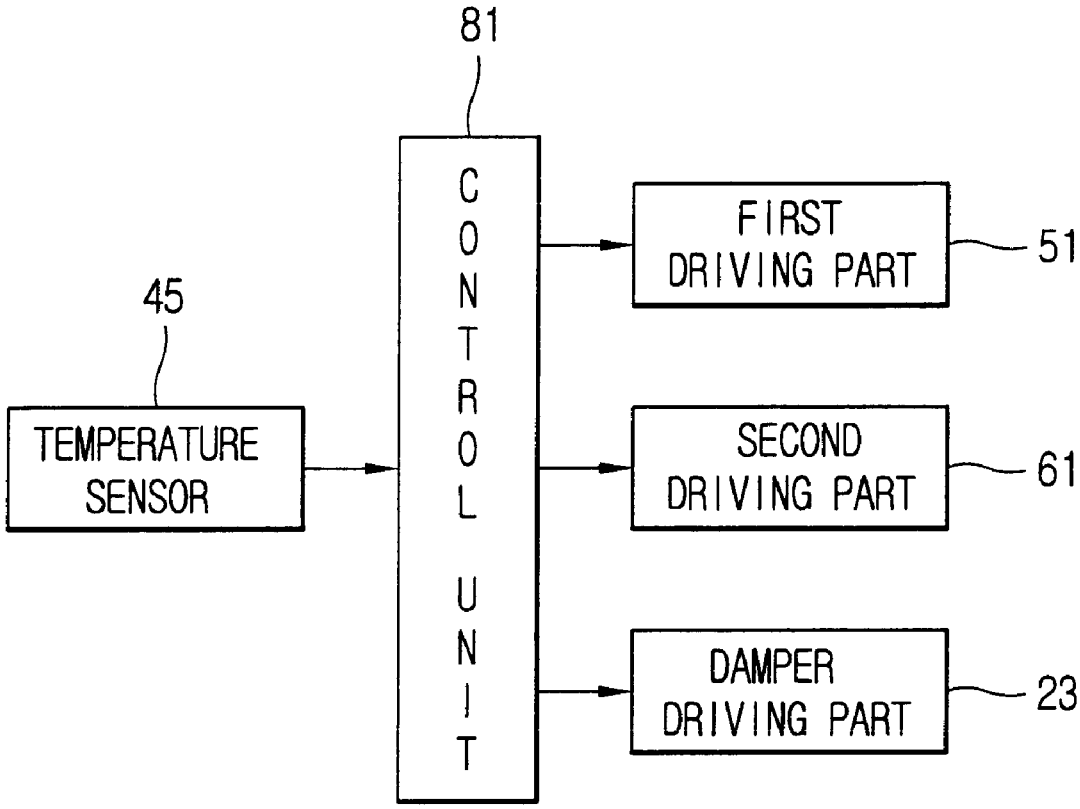
FIG. 9 is a block diagram showing a concentration cooling apparatus for the refrigerator in accordance with the present invention.

FIG. 5 is a partially perspective view showing a disjointed cold air injecting apparatus in accordance with the present invention, FIG. 6 is a partially cut perspective view showing a nozzle of the cold air injecting apparatus in accordance with the present invention, FIG. 7 is a front view showing the cold air injecting apparatus in accordance with the present invention, FIG. 8 is a cross-sectional view taken along section line VIII—VIII of FIG. 7 and FIG. 9 is a block diagram showing a concentration cooling apparatus for the refrigerator in accordance with the present invention.

The cold air injecting apparatus 30 includes a housing 32 which is respectively mounted in the cold air guiding path 19 at a regular interval, a nozzle 39 which is rotably supported in the housing 32, for injecting cold air to a region where a high temperature load is occurred, a temperature sensor 45 which is mounted at the front of the nozzle 39, for sensing the region where the high temperature load was generated inside the chilling chamber 6, rotating together with the nozzle 39, a first driving portion 51 which is mounted in the housing 32, for rotating the nozzle 39 up and down, a second driving portion 61 which is mounted in the housing 32, for rotating the nozzle 39 in the circumferential direction, and a control unit 81 for controlling the first and second driving portions 51 and 61 by receiving a signal from the temperature sensor 45.

The housing 32 is mounted in each cold air guiding hole 24 which is formed in the cold air guiding path 19, and a cover 33 is mounted on the opened surface of the front side of the housing 32.

The housing 32 is formed in a cylindrical shape with a side opened and it is contacted on the nozzle 39 in the direction of the cover 33 at the center, and a protrusion portion 34 for guiding cold air flowed to the housing 32 to the nozzle 39 is positioned therein.

Here, a plurality of first supporting rollers 35 in which the nozzle 39 is rotably supported are mounted in the circumferential direction of the housing 32.

Also, the protrusion portion 34 is formed in a protruded shape to be connected with the cold air guiding hold 24 of the cold air guiding path 19, and the surface where the protrusion portion 34 and the nozzle 39 are contacted is formed in a curved shape so that it can be easily rotated being contacted on the nozzle 39. In the circumferential direction of the protrusion portion 34, a first heater 73 is attached to prevent the part contacted between the nozzle 39 and protrusion portion 34 from being frost.

The cover 33 is formed in a circular shape that the nozzle insertion hole 36 in which the nozzle 39 is inserted at the center portion is formed, a plurality of second supporting rollers 37 for rotably supporting the nozzle 39 is mounted in the circumferential direction of the nozzle insertion hole 36, and a second heater 71 is attached on the inner surface of the cover 33 in the circumferential direction, thus to prevent frost in the portion contacted with the nozzle 39.

Here, the housing 32 and cover 33 are coupled by a mutual combining bolt 38 and they can be combined by another combing means as well as the mutual combining bolt 38.

The nozzle 39 is inserted in the nozzle insertion hole 36 of the cover 32, the front side is exposed to the front portion of the cover 32, and the inner circumferential surface at the rear side is contacted on the protrusion portion 34 of the housing 32.

As shown in FIG. 6, the nozzle 39 is formed in a hemispheric shape, and a cold air injecting port 40 for injecting cold air to the inside of the chilling chamber 6 is formed being penetrated in a position that it is eccentrically positioned at a predetermined interval at the center. A temperature sensor 45 for detecting the internal temperature of the chilling chamber 6 is mounted at the upper side of the nozzle 39.

The nozzle 39 is rotably fixed to the nozzle supporting member 62 which is positioned at a predetermined distance from the outer circumference of the nozzle by the connection rod 52 which is extended to the both sides.

Here, the upper side of the connection rod 52 is inserted in the rod receiving portion 69 which is mounted on the inner circumferential surface of the nozzle supporting member 62 and is rotably supported.

Also, the nozzle supporting member 62 includes a circular portion 63 which is opened so that the nozzle 39 is inserted therein, a cylindrical portion 64 in which the rod receiving portion 69 is mounted in the inner circumferential surface, being vertically extended in the circular portion 63 in the cylindrical shape.

In addition, the outer circumferential surface of the cylindrical portion 64 of the nozzle supporting member 62 is rotably supported in the first supporting roller which is formed in the housing 32.

Therefore, the nozzle 39 can rotate up and down being connected to the nozzle supporting member 62 by the connection rod 52, and it can rotate in the to circumferential direction by rotation of the nozzle supporting member 62.

The cold air injecting port 40 is formed being slanted a predetermined angle from the rear center of the nozzle 39 to the front side and the outlet of the cold air is eccentrically positioned at a side.

The temperature sensor 45 is mounted being slanted a predetermined is angle in the sensor receiving groove 42 which is eccentrically formed in the nozzle 39, and it is desirable that the sensor is composed of infrared sensors for detecting temperature by receiving infrared ray from the heat source at the front of the cold air injection port 40.

Here, it is desirable that the temperature sensor 45 is formed being slanted in the same direction as the cold air injection port 40 to have the region direction that is detected by the temperature sensor 45 and the direction of the cold air which is discharged from the cold air injection port 40 same.

The first driving portion 51 includes a plurality of gears for transmitting a driving force in gear with the connection rod 52, and a first driving motor 56 for generating a driving force being connected to the gears.

The gears include a first gear 53 which is fixed to the connection rod 52, a second gear 55 which is fixed in the driving shaft of the first driving motor 56, a third gear 54 for decelerating the driving force of the first driving motor 56 being in gear between the first and second gears 53 and 55.

It is desirable that the first driving motor 56 includes a stepping motor which is rotated a predetermined step angle.

The first driving portion 51 with the above composition rotates the connection rod 52 as the driving force is transmitted to the connection rod 52 by the gears when the driving force is generated in the first driving motor 56, and the nozzle 39 which is combined with the connection rod 52 by rotation of the connection rod 52 rotates up and down.

The second driving portion 61 includes a rack gear 68 which is fixed on the inner side surface of the cylindrical portion 64 of the nozzle supporting member 62, a pinion gear 57 which is in gear with the rack gear 68, and a second driving motor 66 for driving the pinion gear 57.

It is desirable that the second driving motor 66 includes a step motor which is rotated a predetermined step angle.

In the second driving portion 61 with the above composition, the nozzle supporting member 62 rotates by the pinion gear 57 and the rack gear 68 when the second driving motor 66 generates a driving force.

Therefore, the nozzle 39 which is connected to the nozzle supporting member 62 and the connection rod 52 rotates in the circumferential direction.

On the other hand, as shown in FIG. 9, the control unit 81 determines whether a high temperature load is occurred according to the signal applied from the temperature sensor 45, controls driving of the first and second driving portions 51 and 61, and at the same time, controls a damper driving part 23 which controls a position of the damper 20.

The operation of the refrigerator having the concentration cooling apparatus in accordance with the embodiment of the present invention with the above composition will be described as follows.

Firstly, when the refrigerating cycle and ventilation fan 12 are driven, the cold air cooled passing the refrigerating cycle is discharged to the freezing chamber 4 through the cold air discharging port 13 which is formed in the panel 14, performs a cooling operation circulating the chilling chamber 4, and is supplied to the chilling chamber 6 through the cold air supply path 15 which is formed in the partition 8.

The cold air supplied to the cold air supply path 15 is supplied to the cold air discharging duct 17 and the cold air guiding path 19, and is discharged into the chilling chamber 6 through the cold air discharging port 16 formed in the cold air discharging duct 17, thus to perform a cooling operation. At this time, the damper 20 which is installed in the cold air supply path 19 is operated in the third position N and accordingly, discharging of cold air from the freezing chamber 4 is performed.

On the other hand, when the first driving motor 56 is driven by the control unit 81 of the cold air injecting apparatus 30, the driving force of the first driving motor 56 is transmitted to the connection rod 52 and the nozzle 39 rotates up and down, and when the second driving motor 66 is driven, the nozzle supporting member 62 which is in gear with the driving shaft 65 of the second driving motor 66 rotates by the driving force of the second driving motor 66, thus to rotate the nozzle 39.

At this time, the temperature sensor 45 which is mounted at the front side of the nozzle 39 senses the temperature of the chilling chamber 6 by scanning the internal temperature of the chilling chamber 6 and applies the temperature to the control unit 81.

In case a high temperature load is generated inside the chilling chamber 6 in the above operation, the damper 20 is operated in the second position M and the cold air is supplied just to the cold air guiding path 19, and the cold air injecting apparatus 30 is operated. The nozzle 39 is rotated by the first and second driving portion 51 and 61, the cold air injecting port 40 is directed to the region where the high temperature load is generated, and cold air is concentratedly injected.

That is, the control unit 81 of the cold air injecting apparatus 30 controls the first and second driving motor 56 and 66 so that the cold air injecting port 40 of the nozzle 39 is directed to a predetermined region. Accordingly, the internal temperature of the chilling chamber 6 can rapidly become uniform by performing concentration cooling in the region where the high temperature load is generated.

The concentration cooling apparatus of the refrigerator in accordance with the present invention with the above composition and operation will be described as follows.

The concentration cooling apparatus in accordance with the present invention concentratedly discharges cold air to the region where the high temperature load is occurred inside the chilling chamber by installing a nozzle having a plurality of cold air injection port on the side wall of the chilling chamber, thus to rapidly maintain internal temperature of the chilling chamber by performing a rapid cooling operation.

Also, the concentration cooling apparatus in accordance with the present invention, including the first driving portion for rotating in the nozzle up and down ,and the second driving portion for rotating the nozzle in the circumferential direction, widens the sensing range of the temperature sensor by rotating the nozzle, and can actively cope with the high temperature load generated inside the chilling chamber by widening the cold air discharging range of the cold air injecting port.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A concentration cooling apparatus for a refrigerator, comprising:

a housing which is respectively mounted in one or more cold air guiding paths formed on a side wall of the chilling chamber to guide cold air to the side wall of the chilling chamber;

a nozzle which is rotatably supported in the housing, for concentratedly injecting cold air to a region where a high temperature load is occurred in the chilling chamber;

a temperature sensor which is mounted at the front of the nozzle, for sensing the region where the high temperature load is occurred, rotating together with the nozzle; and a nozzle driving portion for rotating the nozzle up and down as well as in the circumferential direction.

2. The apparatus of claim 1, wherein the housing is attached to be connected to the cold air guiding path and a cover which is mounted to be exposed in the front portion of the front surface which is exposed in the housing.

3. The apparatus of claim 2, wherein the housing is formed in a cylindrical shape opened to the cover portion, a protrusion portion which is rotably contacted with the nozzle from the center to the front direction, and a plurality of first supporting rollers for rotably supporting the nozzle is mounted in the circumferential direction.

4. The apparatus of claim 2, wherein the cover is formed in a circular type that an exposed insertion hole in which the nozzle is rotably inserted, and a plurality of second supporting rollers for rotably supporting the nozzle is mounted on the rear surface.

5. The apparatus of claim 2, wherein the nozzle is inserted in the nozzle insertion hole of the cover, having the front portion which is exposed to the inside of the chilling chamber, is rotably fixed to a nozzle supporting member which is positioned at a predetermined distance from the outer circumference by a connection rod which is extended to both directions.

6. The apparatus of claim 5, wherein a cold air injection port for injecting cold air flowed through the cold air guiding path to the chilling chamber is eccentrically formed to the front surface of the nozzle, and a sensor receiving portion for accommodate a temperature sensor is formed on the upper surface of the cold air injection port in the nozzle.

7. The apparatus of claim 6, wherein the front surface of the nozzle which is exposed to the chilling chamber is formed in a hemispheric shape.

8. The apparatus of claim 6, wherein the temperature sensor is a infrared sensor which detects temperature by receiving the infrared ray radiated from a heat source at the front of the cold air injection port.

9. The apparatus of claim 5, wherein the nozzle driving portion includes:

a first driving portion for rotating the nozzle up and down by rotation of the connection rod; and a second driving portion for rotating the nozzle in the circumferential direction by rotation of the nozzle supporting member.

10. The apparatus of claim 9, wherein the first driving portion includes:

a plurality of gears for transmitting a driving force in gear with the connection rod; and a first driving motor for generating the driving force being connected to the gears.

11. The apparatus of claim 10, wherein the gears include:

a first gear which is fixed in the connection rod;

a second gear which is fixed in the driving shaft of the first driving motor; and a third gear which is in gear between the first and second gears, for reducing a driving force of the first driving motor.

12. The apparatus of claim 10, wherein the first driving motor is a step motor which rotates a predetermined step angle.

13. The apparatus of claim 9, wherein the second driving portion include:

a rack gear which is fixed in the nozzle supporting member;

a pinion gear which is in gear with the rack gear; and a second driving motor for generating a driving force for driving the pinion gear.

14. The apparatus of claim 13, wherein the second driving motor is a step motor which is rotated a predetermined step angle.

* * * * *